US009261839B2

(12) United States Patent
Iida

(10) Patent No.: US 9,261,839 B2
(45) Date of Patent: Feb. 16, 2016

(54) IMAGE FORMING SYSTEM AND OPTION DEVICE

(71) Applicant: CANON KABUSHIKI KAISHA, Tokyo (JP)

(72) Inventor: Masamichi Iida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/668,131

(22) Filed: Mar. 25, 2015

(65) Prior Publication Data

US 2015/0286178 A1 Oct. 8, 2015

(30) Foreign Application Priority Data

Apr. 2, 2014 (JP) ..... 2014-076226

(51) Int. Cl.
*G03G 15/00* (2006.01)

(52) U.S. Cl.
CPC ..... *G03G 15/50* (2013.01); *G03G 2215/00556* (2013.01)

(58) Field of Classification Search
CPC ..... G03G 15/50; G03G 2215/00556
See application file for complete search history.

(56) References Cited

U.S. PATENT DOCUMENTS

| | | | | |
|---|---|---|---|---|
| 6,697,679 | B2 | 2/2004 | Hatakeyama | |
| 8,054,475 | B2 | 11/2011 | Takahashi | |
| 8,626,050 | B2 * | 1/2014 | Takahashi | B41J 11/0095 271/9.01 |
| 2011/0161717 | A1 * | 6/2011 | Nojiri | G03G 15/6508 713/502 |
| 2014/0077451 | A1 * | 3/2014 | Takahashi | B41J 11/0095 271/265.02 |

FOREIGN PATENT DOCUMENTS

| | | | |
|---|---|---|---|
| JP | 05-110753 | A | 4/1993 |
| JP | 2006-326861 | A | 12/2006 |

* cited by examiner

*Primary Examiner* — Rodney Bonnette
(74) *Attorney, Agent, or Firm* — Fitzpatrick, Cella, Harper & Scinto

(57) ABSTRACT

The image forming system includes an image forming apparatus, and an option device including a setting unit that includes a setting port where a value is set in a state of being connected to the image forming apparatus, and an input/output port. The setting unit transmits a response signal to the image forming apparatus according to a comparison result between a value of first data received from the image forming apparatus and the value of a signal set in the setting port. The image forming apparatus transmits recognition data on the option device to the option device according to the response signal. The setting unit sets a value of a signal at the input/output port based on the recognition data.

15 Claims, 6 Drawing Sheets

IMAGE FORMING SYSTEM AND OPTION DEVICE

BACKGROUND OF THE INVENTION

1. Field of the Invention

The present invention relates to an image forming system and an option device. This system includes an image forming apparatus for forming an image through an electrophotography process, performed in such as a copier, and the option device connected to the apparatus.

2. Description of the Related Art

Conventionally, an image forming apparatus, such as a copier or a laser printer, includes a multi-stage mechanism equipped with multiple sheet feeding option devices in a multi-stage configuration. This multi-stage mechanism includes a CPU mounted on a main body of the image forming apparatus, CPUs mounted on respective option devices, and signal lines for communication between the CPUs (e.g., Japanese Patent Application Laid-Open No. 2006-326861). Specific configuration of a multi-stage mechanism of conventional sheet feeding option devices is hereinafter described with reference to the drawings. FIG. 6 is a schematic diagram illustrating the multi-stage configuration of the conventional sheet feeding option devices. In FIG. 6, the image forming apparatus 1 is mounted with a CPU 1*a*. Each sheet feeding option device 23 is mounted with a CPU 2. In FIG. 6, three stages of the sheet feeding option devices 23 are stacked. In this configuration, sheet feeding option devices 23-*a*, 23-*b* and 23-*c* are mounted with CPUs 2-*a*, 2-*b* and 2-*c*, respectively. Each of the CPUs (CPUs 2-*a*, 2-*b* and 2-*c*) of the sheet feeding option devices 23 includes a RAM that is for storing after-mentioned unique address information but is not illustrated.

Here, it is assumed that the sheet feeding option device 23 that can be stacked in a multi-stage manner is used only in a single stage or in any number of stages. Accordingly, the following configuration is required. That is, the CPU 1*a* of the image forming apparatus 1 and the CPUs 2-*a*, 2-*b* and 2-*c* of the sheet feeding option devices 23 are connected to each other by bus lines for serial communication where the CPU 1*a* serves as a master. Through the bus lines, the CPU 1*a* and the CPU 2 of each sheet feeding option device 23 communicate with each other. Thus, CMD, STS and CLK lines connected to the CPU 1*a* of the image forming apparatus 1 are connected to the respective CPUs 2 (CPUs 2-*a*, 2-*b* and 2-*c*) of the sheet feeding option devices 23 in parallel. The CMD line connected to the CPU 2 of the sheet feeding option device 23 downstream of the bus line is provided with gate circuits G-a, G-b and G-c. The output terminal of the gate circuit is in a closed state so as not to transmit a signal to a downstream side until the CPU 1*a* of the image forming apparatus 1 recognizes the attachment state of the corresponding sheet feeding option device 23. Subsequently, communication between the CPU 2 of the sheet feeding option device 23 upstream of the bus line and the CPU 1*a* of the image forming apparatus 1 is established. A unique address is assigned to the corresponding CPU 2, and stored in the RAM, not illustrated. The CPU 2 then controls an output port P0 to open the output terminal of the gate circuit G. The CPU 1*a* can thus communicate with the CPU 2 of the sheet feeding option device 23 downstream of the bus line. Such a configuration allows the CPU 1*a* to correctly recognize the configuration of the sheet feeding option device 23 even in the case where the number of attached stages of the sheet feeding option devices 23 is not fixed.

However, according to the configuration illustrated in FIG. 6, if an unidentified number of sheet feeding option devices 23 are attached, the CPU 1*a* of the image forming apparatus 1 is required to correctly recognize the configuration of the sheet feeding option devices 23. For such recognition, unique addresses are required to be assigned to the respective sheet feeding option devices 23 for communication with the corresponding stages of these devices. Accordingly, the sheet feeding option device 23 is required to be mounted with the CPU 2 that includes the RAM for storing the unique address information from the CPU 1*a*. This requirement is a factor of increasing the cost.

SUMMARY OF THE INVENTION

The present invention is made in such situations, and enables the address of an option device to be set using a simple configuration.

To solve the problem, it is provided, an image forming system including an image forming apparatus, and an option device connectable to the image forming apparatus, wherein the image forming apparatus includes a communication unit that performs data communication with the option device via a communication line, wherein the option device includes a receiving unit that receives data transmitted from the image forming apparatus via the communication line, a transmitting unit that transmits data to the image forming apparatus via the communication line, and a setting unit that includes a setting port where a value is set in a state of being connected to the image forming apparatus, and an input/output port, and wherein the setting unit executes comparison between a value of first data received from the image forming apparatus and the value set in the setting port, and transmits a response signal to the image forming apparatus according to a result of the comparison, and the image forming apparatus transmits recognition data on the option device to the option device according to the response signal, and the setting unit sets a value of a signal at the input/output port based on the recognition data.

Furthermore, it is provided, an option device connectable to an image forming apparatus, including a receiving unit that receives data transmitted from the image forming apparatus, a transmitting unit that transmits data to the image forming apparatus, and a setting unit that includes a setting port where a value of a signal is set in a state of being connected to the image forming apparatus, and an input/output port where a value of a signal is set based on data transmitted from the image forming apparatus, wherein the setting unit executes comparison between a value of first data transmitted from the image forming apparatus and the value set in the setting port, transmits a response signal to the image forming apparatus according to a result of the comparison, and sets the value of the signal at the input/output port based on recognition data on the option device transmitted from the image forming apparatus.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiment 1

[Overview of Image Forming Apparatus]

Figure 1:
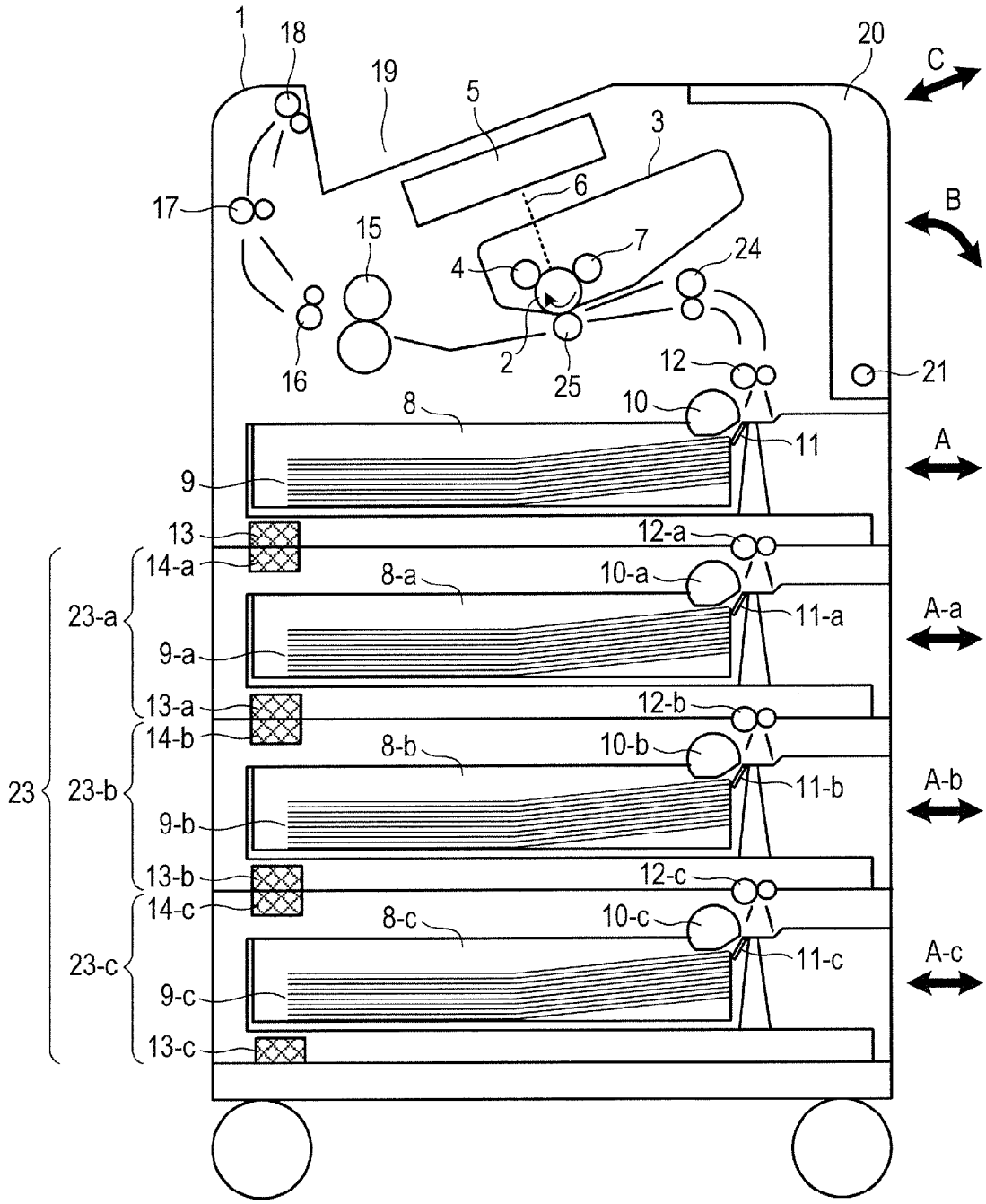
FIG. 1 is a schematic configuration diagram of an image forming apparatus of each of Embodiments 1 and 2.

FIG. 1 is a schematic sectional view illustrating a configuration of an image forming apparatus 1 of Embodiment 1. In FIG. 1, a photosensitive drum 2, which is an image bearing member, is rotatably supported at the opposite ends of the drum by a process cartridge 3 that contains black developing material (toner). The photosensitive drum 2 is rotatably driven in an arrow direction (clockwise direction) in FIG. 1 by a drive motor and a drive transmission mechanism, which are not illustrated. An organic photoconductive layer is applied and formed on the surface of the photosensitive drum 2. Through application of charging voltage onto a charging roller 4, the surface of the photosensitive drum 2 is uniformly charged, and exposed to laser light 6 emitted from a laser scanner unit 5, which is an exposure unit, to form an electrostatic latent image. A developing unit 7 causes toner to adhere to the electrostatic latent image, which is developed as a toner image.

A sheet feeding unit of the image forming apparatus 1 includes a sheet feeding cassette 8, a sheet feeding roller 10, a separation pad 11 and a conveyance roller pair 12. Recording sheets 9 are stacked on the sheet feeding cassette 8. The recording sheet 9 is fed at a predetermined timing by the sheet feeding roller 10 driven by the drive motor and the drive transmission mechanism, which are not illustrated, and is separated by a frictional force due to the separation pad 11, and the single recording sheet 9 is fed to the conveyance roller pair 12. Subsequently, the recording sheet 9 passes through the conveyance roller pair 12 and a registration roller pair 24, and is conveyed to a nip portion at a transfer position where the photosensitive drum 2 is in contact with a transfer roller 25. At the nip portion, the transfer roller 25 to which a predetermined voltage is applied transfers the toner image on the photosensitive drum 2 onto the recording sheet 9. The recording sheet 9 bearing the transferred toner image is conveyed to a fixing roller pair 15. The fixing roller pair 15 melts and fixes the toner image on the recording sheet 9 owing to heat and pressure. The recording sheet 9 conveyed by the fixing roller pair 15 then passes through discharge roller pairs 16, 17 and 18, and is ejected to and stacked on a discharge tray 19.

The sheet feeding cassette 8 can be moved (extracted) in the right direction of an arrow A in FIG. 1, thereby allowing the recording sheets 9 to be added. Left movement (insertion) in the left direction of the arrow A allows this cassette to be attached to the image forming apparatus 1. An open/close door 20 can be turned about a shaft 21. This door is turned in the right direction of an arrow B to be brought into an open state, and is turned in the left direction to be brought into a closed state. Through a main body opening due to the open/close door 20, the process cartridge 3 can be attached to and detached from the image forming apparatus 1 in an arrow C direction. The image forming apparatus is not limited to the image forming apparatus illustrated in FIG. 1. Alternatively, this apparatus may be, for instance, a color image forming apparatus that includes multiple image forming units.

[Configuration of Sheet Feeding Option Device]

A sheet feeding option device 23 is an additional sheet feeding unit provided for allowing different types of recording sheets and a further number of recording sheets to be supplied. In this embodiment, three sheet feeding option devices 23 can be attached at the maximum. FIG. 1 illustrates a state where three sheet feeding option devices 23 are stacked and cascaded. Symbols are assigned to positions in each sheet feeding option device 23 corresponding to those of the sheet feeding unit of the image forming apparatus 1 such that a suffix -a is assigned to each element on a first stage (upper stage), a suffix -b is assigned to each element on a second stage (middle stage), and a suffix -c is assigned to each element on a third stage (lower stage). The sheet feeding option devices 23-*a*, 23-*b* and 23-*c* have the same configuration, and can be stacked in any order. However, in the case where two or more sheet feeding option devices 23 are attached, the devices are required to be attached adjacent to each other in the vertical direction. Arrows A-a, A-b and A-c in FIG. 1 indicate movement directions in which sheet feeding cassettes 8-*a*, 8-*b* and 8-*c* of the sheet feeding option devices 23-*a*, 23-*b* and 23-*c* are attached and detached, respectively.

Drawer connectors 13, 13-*a*, 13-*b* and 13-*c* illustrated in FIG. 1 are for supplying signals from the image forming apparatus 1 or the sheet feeding option device 23 attached on the upper stage to the sheet feeding option device 23 attached on the lower stage. In conformity with the drawer connectors 13, 13-*a*, 13-*b* and 13-*c*, the sheet feeding option devices 23 attached on the lower stages are provided with drawer connectors 14-*a*, 14-*b* and 14-*c*. Via the drawer connectors, signals to the sheet feeding option devices 23 are relayed.

[Configuration of Extended IO]

Figure 2:
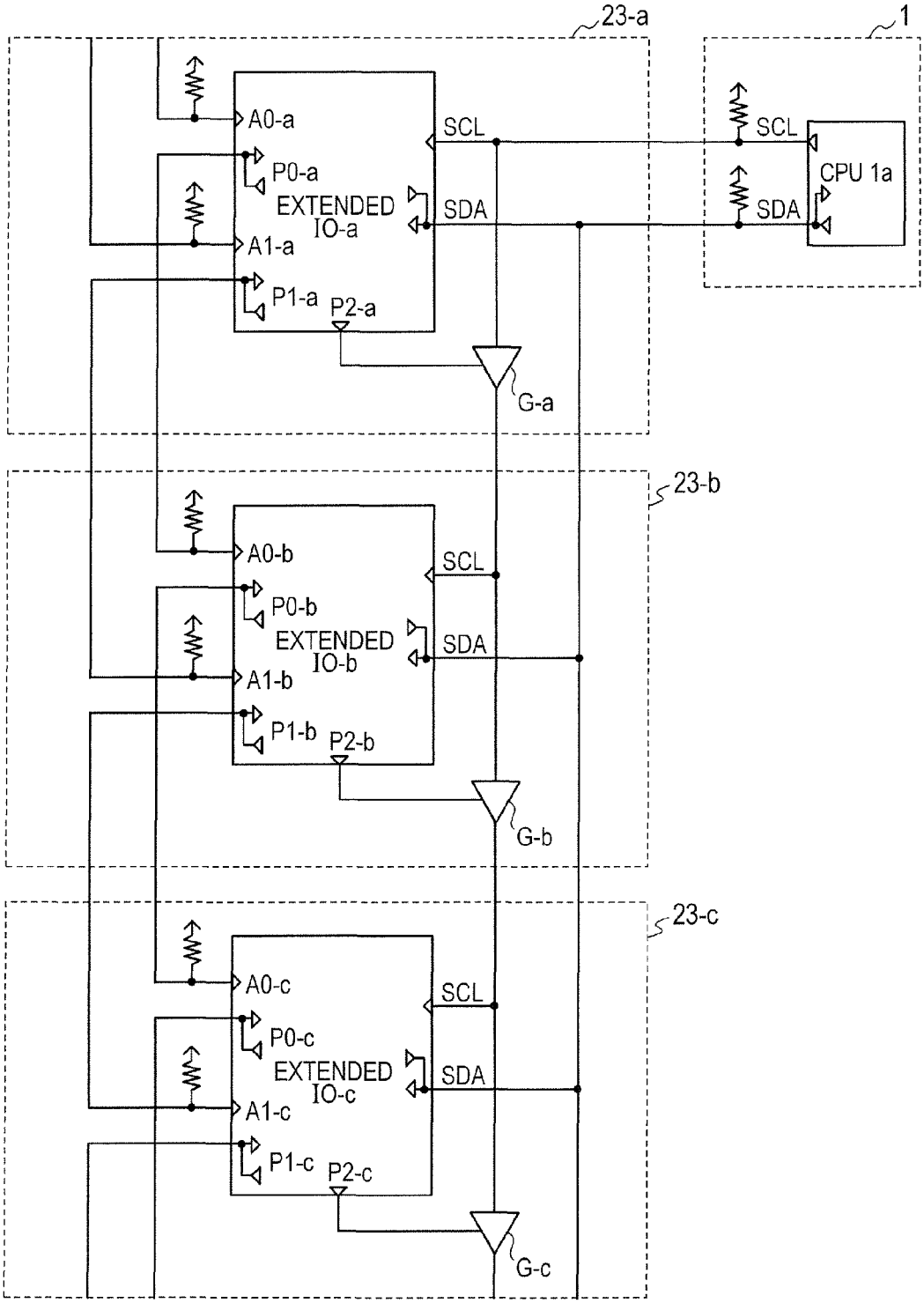
FIG. 2 is a diagram illustrating a configuration of connection between the image forming apparatus and sheet feeding option devices in Embodiment 1.

Next, a configuration that achieves multi-stage sheet feeding option devices using integrated circuits including address setting terminals is described with reference to FIG. 2. FIG. 2 is a schematic diagram of a configuration of connection between the CPU 1*a* of the image forming apparatus and extended IOs, which are after-mentioned integrated circuits of the three sheet feeding option devices 23-*a*, 23-*b* and 23-*c*. The integrated circuits function as address setting units that set addresses of the respective sheet feeding option devices according to data transmitted from the CPU 1*a*. The integrated circuit includes not only the address setting terminal, which is an input port, but also a universal input/output (IO) terminal that serves as an input port or an output port according to setting. Furthermore, in the integrated circuit, data can be set in the input/output terminal through $I^2C$ communication, which will be described later. The integrated circuit is hereinafter referred to as an extended IO. In this embodiment, description is made using an example of the extended IO. However, the configuration is not limited to the extended IO. Alternatively, another element having a similar function can be adopted.

In FIG. 2, the CPU 1*a* that controls the image forming apparatus 1 is embedded in the image forming apparatus 1. The CPU 1*a* includes a ROM and a RAM, not illustrated. The ROM is a memory that stores a program and data for controlling the image forming apparatus 1. The RAM is a memory used for temporarily storing information from a control program executed by the CPU 1*a*. The extended IO, which is an extended input/output unit including address setting terminals A0 and A1, is embedded in the sheet feeding option device 23. More specifically, in FIG. 1, in the sheet feeding option device 23-*a* attached immediately below the image forming apparatus 1, an extended IO-a is embedded. In the sheet feeding option device 23-*b* attached immediately below the sheet feeding option device 23-*a*, an extended IO-b is embedded. Furthermore, in the sheet feeding option device 23-*c* attached immediately below the sheet feeding option device 23-*b*, an extended IO-c is embedded. Communication between the CPU 1*a* and the extended IO of each sheet feeding option device 23 is performed through $I^2C$ communication, which is serial communication through a two-wire $I^2C$ (Inter IC) bus. In this embodiment, description is made using the example where $I^2C$ communication is used as a communication scheme between the image forming apparatus 1 and each sheet feeding option device 23. However, the configuration is not limited to this example. Alternatively, for instance, another communication scheme, such as a UART (universal asynchronous transmitting/receiving circuit) having the same two-wire configuration, can be used in a similar manner.

[Overview of $I^2C$ Communication]

For $I^2C$ communication, two bus lines are used that are a serial clock line (SCL) as a clock signal path and a serial data line (SDA) as a data signal path and configure an $I^2C$ bus as a communication path. A serial clock signal (SCL signal) is output from the CPU 1*a* of the image forming apparatus 1 to the serial clock line, and supplied to an SCL terminal of the extended IO of each sheet feeding option device 23. At the CPU 1*a* of the image forming apparatus 1 and the extended IO of each sheet feeding option device 23, an SDA signal flowing in the serial data line is read and the SDA signal is output (written), in synchronization with the SCL signal. Communication between the CPU 1*a* of the image forming apparatus 1 and the extended IO of each sheet feeding option device 23 according to $I^2C$ communication procedures is performed according to the following procedures. As will be described later, when the power supply to the sheet feeding option device 23 is turned on, the CPU 1*a* of the image forming apparatus 1 uses the SDA signal to preliminarily set address data that is recognition data for identifying each sheet feeding option device 23 in the address setting terminals A0 and A1 of the extended IO. The address data is thus different for each sheet feeding option device. In the case of communication with the extended IO of each sheet feeding option device 23, the extended IO of the opposite party of communication is to be designated. Accordingly, the CPU 1*a* of the image forming apparatus 1 sets, in the SDA signal, the address data for identifying the extended IO of the opposite party of communication, and outputs the signal. The extended IO, having received the SDA signal including the address data, compares the data with the address data set in the extended IO itself. According to the comparison result, the extended IO having the same address data sets, in the SDA signal, an ACK (acknowledge) signal that is a response signal and then transmits the signal to the CPU 1*a*. The CPU 1*a*, having received the ACK signal, subsequently sets data in the SDA signal and transmits the signal. The corresponding extended IO reads the data set in the SDA signal.

[Connection of Extended IO]

As illustrated in FIG. 2, the extended IO includes address setting terminals A0 and A1 that are setting ports, and universal ports P0, P1 and P2 that are universal input/output ports. The extended IO has a configuration allowing address data having 2-bit configuration to be set through the address setting terminals A0 and A1. The address setting terminals A0 and A1 of each extended IO are connected to a power supply voltage via pull-up resistors. Furthermore, the address setting terminals A0 and A1 are connected to the respective universal ports P0 and P1 of the sheet feeding option device 23 that is adjacent and on the upper stage side. That is, the address setting terminals A0-*a* and A1-*a* of the extended IO-a of the sheet feeding option device 23-*a* on the upper stage are connected to the power supply voltage via pull-up resistors. Meanwhile, the address setting terminals A0-*b* and A1-*b* of the extended IO-b of the sheet feeding option device 23-*b* on the middle stage are pull-up-connected to the power supply voltage, and connected to the respective universal ports P0-*a* and P1-*a* of the extended IO-a of the sheet feeding option device 23-*a* on the upper stage. Furthermore, the address setting terminals A0-*c* and A1-*c* of the extended IO-c of the sheet feeding option device 23-*c* on the lower stage are pull-up-connected to the power supply voltage, and connected to the respective universal ports P0-*b* and P1-*b* of the extended IO-b of the sheet feeding option device 23-*b* on the middle stage.

To limit propagation (relaying) of the SCL signal to the sheet feeding option device 23 on the lower stage, the sheet feeding option devices 23-*a*, 23-*b* and 23-*c* are provided with gate circuits G-a, G-b and G-c, respectively, which are gate units, on the serial clock line. The gate circuits G-a, G-b and G-c include enabled terminals connected to the universal ports P2-*a*, P2-*b* and P2-*c* of the respective extended IOs. When the input of the enabled terminal is at high level, the gate circuits G-a, G-b and G-c output the SCL signals. When the input is at low level, the circuits break the outputs of SCL signals. That is, by setting the outputs of the universal ports P2-*a*, P2-*b* and P2-*c* of the respective extended IOs to high level, the SCL signals are output from the output terminals of the corresponding gate circuits G-a, G-b and G-c to the sheet feeding option devices on the lower stage side. The extended IO internally has a power-on-reset function. When the power is turned on, the inside of the extended IO is reset and the universal ports P2, P1 and P0 are set to a high-impedance state. As a result, the address setting terminals A0 and A1 of each of the extended IO-a, IO-b and IO-c are brought into a state where the high level signals are input. FIG. 2 does not illustrate the drawer connectors described above. However, the SCL signal, the SDA signal, the address setting terminal signal and the universal port signal, which are to be relayed between the sheet feeding option devices, are relayed via the drawer connectors between the sheet feeding option devices.

[Control Sequence of Setting Address in Extended IO Unit]

Figure 3:
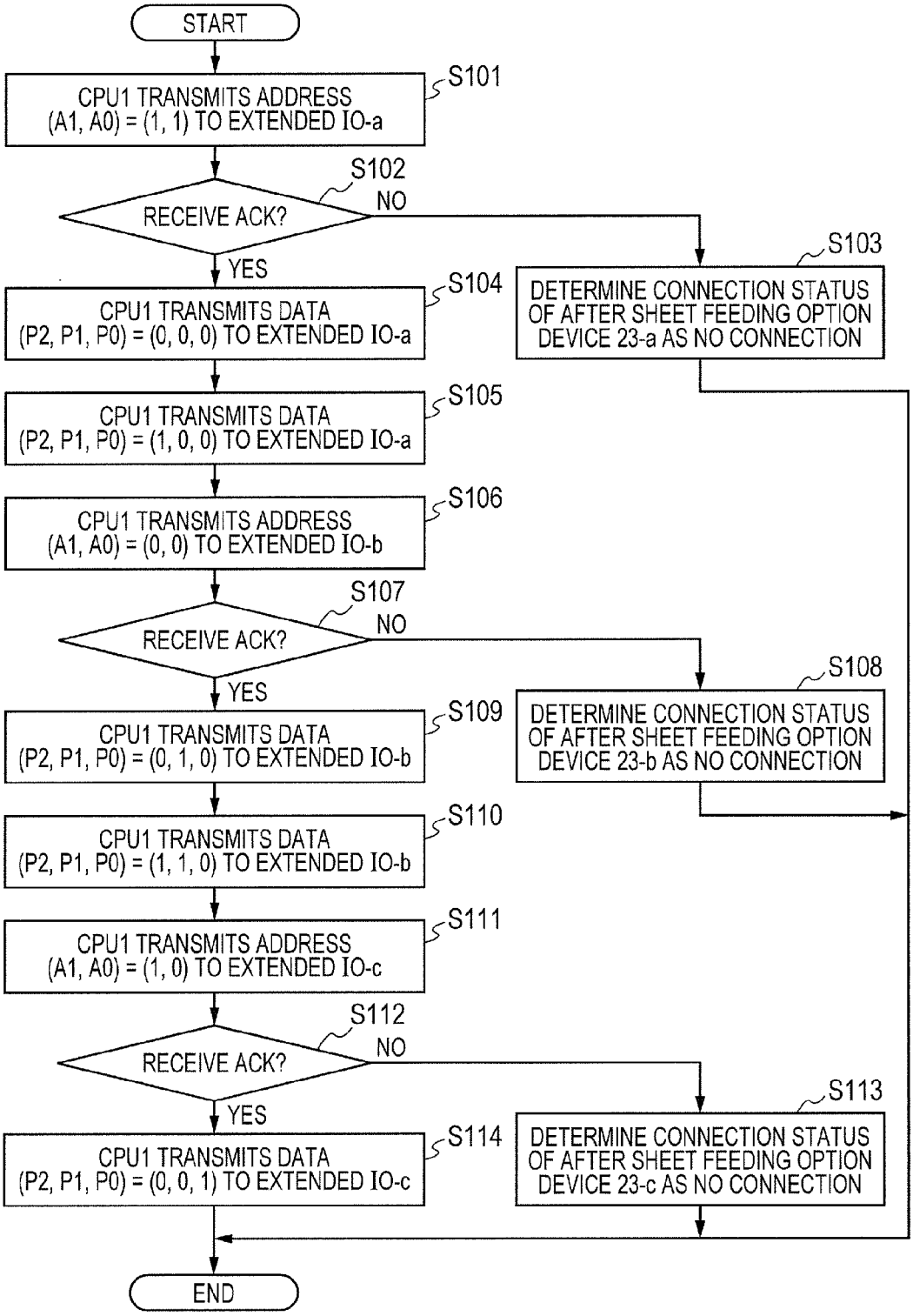
FIG. 3 is a flowchart illustrating a control sequence of address setting in Embodiment 1.

A control sequence of setting address data in the extended IO of each of the sheet feeding option devices 23-*a*, 23-*b* and 23-*c* is now described with reference to FIG. 3. FIG. 3 is a flowchart illustrating a control sequence of the CPU 1*a* of the image forming apparatus 1 setting address data in the extended IO of each sheet feeding option device 23. Procedures of setting the address data of each extended IO based on the configuration illustrated in FIG. 2 where the sheet feeding option devices 23-*a*, 23-*b* and 23-*c* are attached are hereinafter described. The control sequence illustrated in FIG. 3 is activated when the power supply to the sheet feeding option device 23 is turned on. When the power supply to the sheet feeding option device 23 is turned on, the power-on-reset function in the extended IO embedded in each of the sheet feeding option devices 23-*a*, 23-*b* and 23-*c* operates. Accordingly, the resister in each extended IO is cleared, the universal ports P0 to P2 are set to the high-impedance state, and the address setting terminals A1 and A0 are brought into a state where the high level signals are input.

In step (hereinafter, referred to as S) 101, the CPU 1*a* of the image forming apparatus 1 transmits the SDA signal that includes the address information for communication with the extended IO-a of the sheet feeding option device 23-*a*. That is, the CPU 1*a* of the image forming apparatus 1 transmits the SDA signal designating the extended IO where the address information identifying the extended IO-a in this embodiment is 1 and 1, that is, the inputs to the address setting terminals A1 and A0 are 1 and 1, respectively. The extended IO-a of the sheet feeding option device 23-*a* reads the address information transmitted through the SDA signal, and compares the information with the input states of the address setting terminals A1 and A0 (hereinafter, also referred to as terminals A1 and A0). Since the input states of the terminals A1 and A0 are 1 and 1, that is, the high level signals are input, the extended IO-a sets the ACK signal that is a reply signal in the SDA signal, and transmits the signal to the CPU 1*a* of the image forming apparatus 1.

In S102, the CPU 1*a* of the image forming apparatus 1 reads the reply signal to the transmitted address information, and determines whether the signal is the ACK signal or not. If the signal is the ACK signal (ACK reception), the processing proceeds to S104. If the signal is not the ACK signal, the processing proceeds to S103. In S103, the CPU 1*a* of the image forming apparatus 1 determines that there is no connection of and after the sheet feeding option device 23-*a*, that is, the sheet feeding option devices 23-*a*, 23-*b* and 23-*c* are not attached, and finishes the processing.

In S104, the CPU 1*a* of the image forming apparatus 1 then transmits, to the extended IO-a, the SDA signal for setting the address information on the extended IO-b to confirm presence or absence of the sheet feeding option device 23-*b*. That is, the CPU 1*a* of the image forming apparatus 1 transmits the SDA signal where the port information to be set in the universal ports P2, P1 and P0 of the extended IO-a is 0, 0 and 0, that is, the outputs of the universal ports P2, P1 and P0 are for setting low level, respectively. The extended IO-a, having received the SDA signal, sets the universal ports P2-*a*, P1-*a* and P0-*a* that are in the high-impedance state to low level, thereby causing the universal ports P2-*a*, P1-*a* and P0-*a* to output the low level signals. As illustrated in FIG. 2, the outputs of the universal ports P1-*a* and P0-*a* are input into the respective terminals A1-*b* and A0-*b* of the extended IO-b.

Subsequently, in S105, the CPU 1*a* of the image forming apparatus 1 outputs the SDA signal where port information to be set in the universal ports P2, P1 and P0 of the extended IO-a is 1, 0 and 0, that is, the output of the universal port P2 is set to high level and the outputs of the ports P1 and P0 remain at low level. The extended IO-a, having received the SDA signal, changes the output of the universal port P2-*a* from low level to high level, and the high level signal is output from the universal port P2-*a* and input into the gate circuit G-a. The gate circuit G-a receives the high level signal from the universal port P2-*a*, thereby supplying (relaying) the SCL signal that is the serial clock signal to the extended IO-b of the sheet feeding option device 23-*b* on the middle stage.

In S106, the CPU 1*a* of the image forming apparatus 1 transmits the SDA signal designating the extended IO-b where address information is 0 and 0, that is, the address setting terminals A1 and A0 are 0 and 0, respectively, to communicate with the extended IO-b of the sheet feeding option device 23-*b*. The extended IO-b of the sheet feeding option device 23-*b* reads the address information transmitted through the SDA signal, and compares the information with the input states of the terminals A1 and A0. As described above, the terminals A1 and A0 of the extended IO-b receive the low level signals from the universal ports P1 and P0 of the extended IO-a. Accordingly, the ACK signal that is a reply signal is set in the SDA signal, and the signal is transmitted to the CPU 1*a* of the image forming apparatus 1.

In S107, the CPU 1*a* of the image forming apparatus 1 reads the reply signal to the transmitted address information, and determines whether the signal is the ACK signal or not. If the signal is the ACK signal (ACK reception), the processing proceeds to S109. If the signal is not the ACK signal, the processing proceeds to S108. In S108, the CPU 1*a* of the image forming apparatus 1 determines that there is no connection of and after the sheet feeding option device 23-*b*, that is, the sheet feeding option devices 23-*b* and 23-*c* are not attached, and finishes the processing.

In S109, the CPU 1*a* of the image forming apparatus 1 then transmits, to the extended IO-b, the SDA signal for setting the address information on the extended IO-c to confirm presence or absence of the sheet feeding option device 23-*c*. That is, the CPU 1*a* of the image forming apparatus 1 transmits the SDA signal where port information to be set in the universal ports P2, P1 and P0 of the extended IO-b is 0, 1 and 0, that is, the output of the universal port P2 is set to low level, the output of the port P1 high level, and the output of the port P0 low level. The extended IO-b, having received the SDA signal, sets the universal ports P2-*b*, P1-*b* and P0-*b* that are in the high-impedance state, to low level, high level and low level, respectively. Accordingly, from the universal ports P2-*a*, P1-*a* and P0-*a*, the low level signal, the high level signal and the low level signal are output, respectively. As illustrated in FIG. 2, the outputs of the universal ports P1-*b* and P0-*b* are input into the terminals A1-*c* and A0-*c* of the extended IO-c, respectively.

Subsequently, in S110, the CPU 1*a* of the image forming apparatus 1 transmits the SDA signal where port information to be set in the universal ports P2, P1 and P0 of the extended IO-b is 1, 1 and 0, that is, the outputs of the universal ports P2 and P1 are set to high level and the output of the port P0 low level. The extended IO-b, having received the SDA signal, changes the output of the universal port P2-*b* from low level to high level. The high level signal is output from the universal port P2-*b*, and input into the gate circuit G-b. The gate circuit G-b receives the high level signal from the universal port P2-*b*, thereby supplying (relaying) the SCL signal that is the serial clock signal, to the extended IO-c of the sheet feeding option device 23-*c* on the lower stage.

In S111, the CPU 1*a* of the image forming apparatus 1 transmits the SDA signal designating the extended IO-c where address information is 1 and 0, that is, address setting terminals A1 and A0 are 1 and 0, respectively, to communicate with the extended IO-c of the sheet feeding option device 23-*c*. The extended IO-c of the sheet feeding option device 23-*c* reads the address information transmitted through the SDA signal, and compares the information with the input states of the terminals A1 and A0. As described above, the terminals A1 and A0 of the extended IO-c receive the high level and low level signals from the universal ports P1 and P0 of the extended IO-b, respectively. Accordingly, the ACK signal that is a reply signal is set in the SDA signal, and the signal is transmitted to the CPU 1*a* of the image forming apparatus 1.

In S112, the CPU 1*a* of the image forming apparatus 1 reads the reply signal to the transmitted address information, and determines whether the signal is the ACK signal or not. If the signal is the ACK signal (ACK reception), the processing proceeds to S114. If the signal is not the ACK signal, the processing proceeds to S113. In S113, the CPU 1*a* of the image forming apparatus 1 determines that there is no connection to the sheet feeding option device 23-*c*, that is, the sheet feeding option device 23-*c* is not attached, and finishes the processing.

In S114, the CPU 1*a* of the image forming apparatus 1 transmits, to the extended IO-c, the SDA signal for setting empty address information on the extended IO. That is, the CPU 1*a* of the image forming apparatus 1 transmits the SDA signal where port information to be set in the universal ports P2, P1 and P0 of the extended IO-c is 0, 0 and 1, that is, the outputs of the universal ports P2 and P1 are set to low level and the output of the port P0 high level. The extended IO-b, having received the SDA signal, sets the universal ports P2-*b*, P1-*b* and P0-*b* that are in the high-impedance state to low level, low level and high level, respectively. Accordingly, the universal ports P2-*a*, P1-*a* and P0-*a* output the low level signal, the low level signal and the high level signal, respectively, and the processing is finished.

FIG. 3 only illustrates the reception confirmation of the ACK signal in the case where the CPU 1*a* of the image forming apparatus 1 transmits the address information to the extended IO of the sheet feeding option device 23. In the case of setting data in the universal port, description of a process of determining the reception confirmation of the ACK signal is omitted. If the ACK signal is not received during data setting into the universal port, the CPU 1*a* of the image forming apparatus 1 may execute a process of setting data in the universal port again. The order of the address data items setting in the extended IO illustrated in FIG. 3 is an example. The address data items of the address setting terminals A1 and A0 of the extended IO-a on the upper stage are fixed to (1, 1). However, the address data items of the extended IO-b and extended IO-c are not necessarily (0, 0) and (1, 0), which are illustrated in FIG. 3.

As described above, this embodiment can set the addresses in the option devices through a simple configuration. In this embodiment, the addresses can be set to the multi-stage sheet feeding option devices using the extended IOs, each of which is an integrated circuit having an inexpensive and simple configuration in comparison with a CPU having a RAM.

Embodiment 2

Embodiment 1 has described the configuration where the output of the universal port of the extended IOs of the sheet feeding option device 23 on the upper stage side is input into the address setting terminal of the extended IO of the sheet feeding option device on the lower stage side, thereby causing the extended IO on the upper stage side to set the address in the extended IO on the lower stage side. Embodiment 2 describes a configuration where the universal port is connected to the address setting terminal of the same extended IO, thereby causing the extended IO to set the own address. The configurations of the image forming apparatus 1 and the sheet feeding option devices 23 are similar to the configurations in Embodiment 1. Accordingly, the description is omitted.

[Connection of Extended IO]

Figure 4:
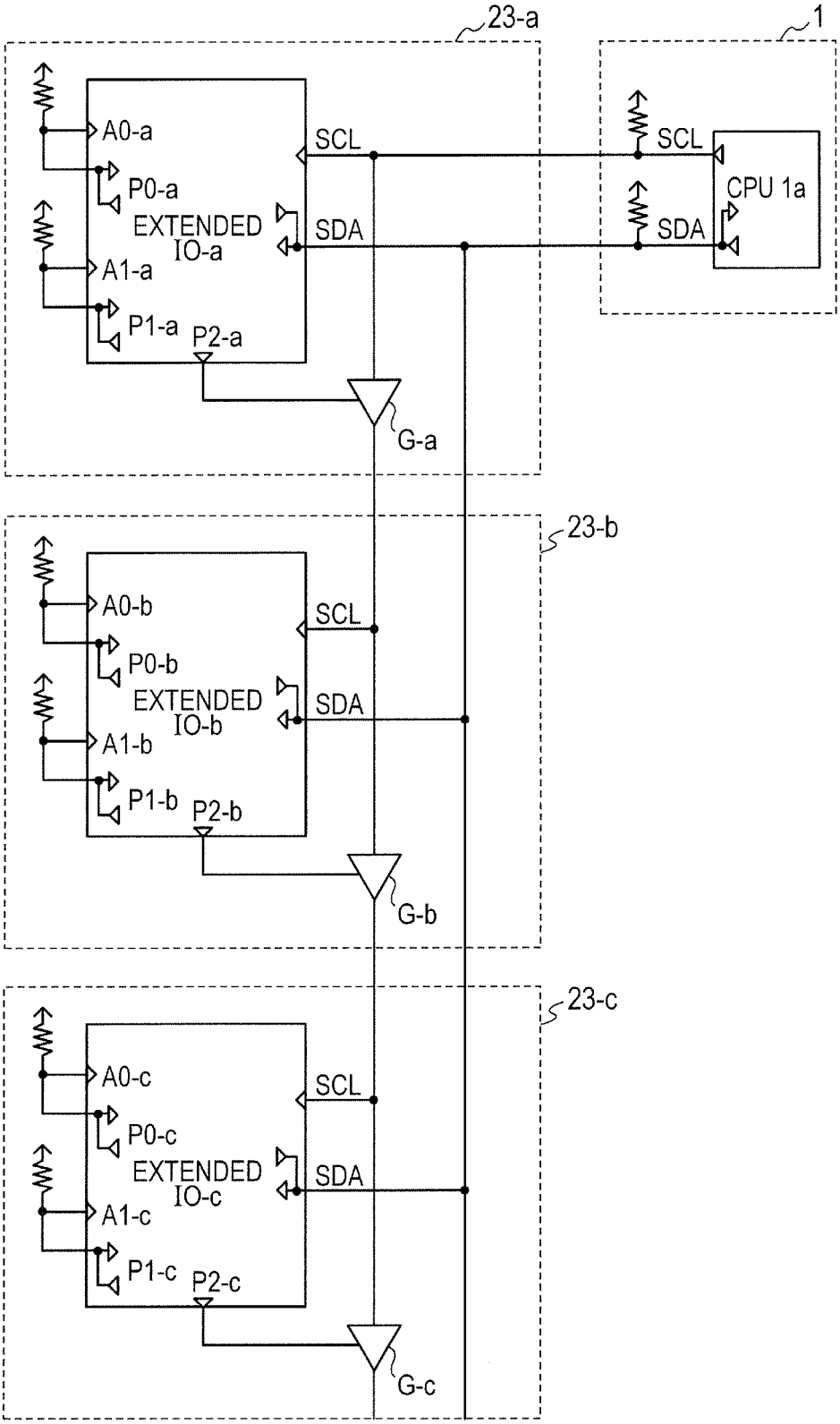
FIG. 4 is a diagram illustrating a configuration of connection between the image forming apparatus and sheet feeding option devices in Embodiment 2.

The configuration of achieving the multi-stage sheet feeding option devices 23 using the extended IO in this embodiment is now described with reference to FIG. 4. FIG. 4 is a schematic diagram illustrating a configuration of connection between the CPU 1*a* of the image forming apparatus 1 and the extended IOs of three sheet feeding option devices 23-*a*, 23-*b* and 23-*c*. The configuration of the extended IOs and communication procedures between the CPU 1*a* and the extended IOs are similar to those in Embodiment 1. Accordingly, the description is omitted.

In Embodiment 1, the extended IO of the sheet feeding option device 23 on the upper stage side sets the address of the extended IO of the sheet feeding option device 23 on the lower stage side. Accordingly, the output of the universal port of the extended IO on the upper stage side is input into the address setting terminal of the extended IO on the lower stage side. On the contrary, in this embodiment, the extended IO sets the own address data, based on address information from the CPU 1*a*. Accordingly, in this embodiment, the address setting terminals A0 and A1 of the extended IO are connected to the power supply voltage via pull-up resistors, and connected to the respective universal ports P0 and P1 of the same extended IO. More specifically, the address setting terminals A0-*a* and A1-*a* of the extended IO-a are connected to the universal ports P0-*a* and P1-*a*, respectively. The address setting terminals A0-*b* and A1-*b* of the extended IO-b are connected to universal ports P0-*b* and P1-*b*, respectively. Likewise, the address setting terminals A0-*c* and A1-*c* of the extended IO-c are connected to universal ports P0-*c* and P1-*c*, respectively. That is, in this embodiment, the input signal to the address setting terminal is not supplied from another extended IO. Instead, the signal is supplied from the universal port of the same extended IO.

[Control Sequence of Setting Address in Extended IO Unit]

Figure 5:
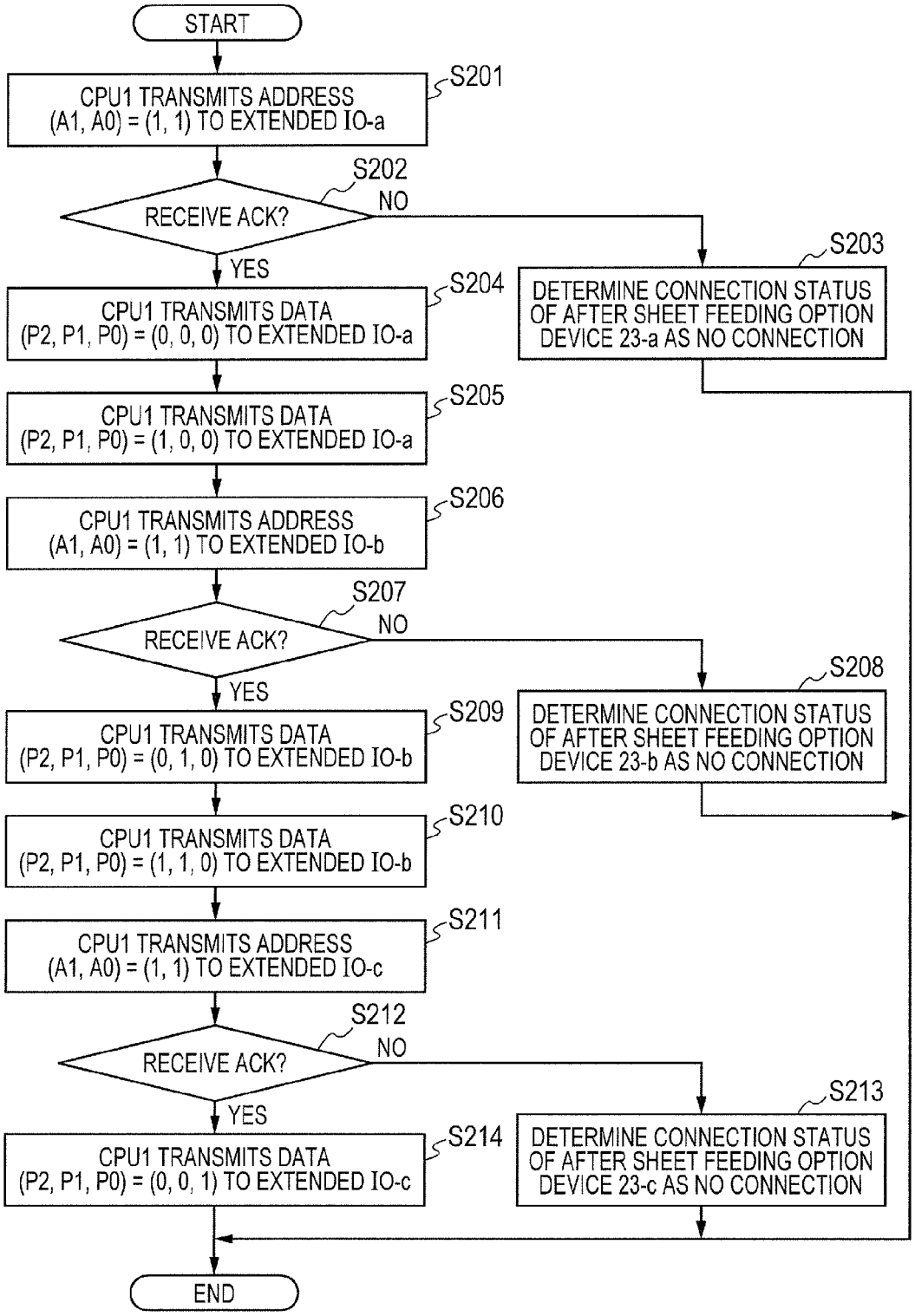
FIG. 5 is a flowchart illustrating a control sequence of address setting in Embodiment 2.
Figure 6:
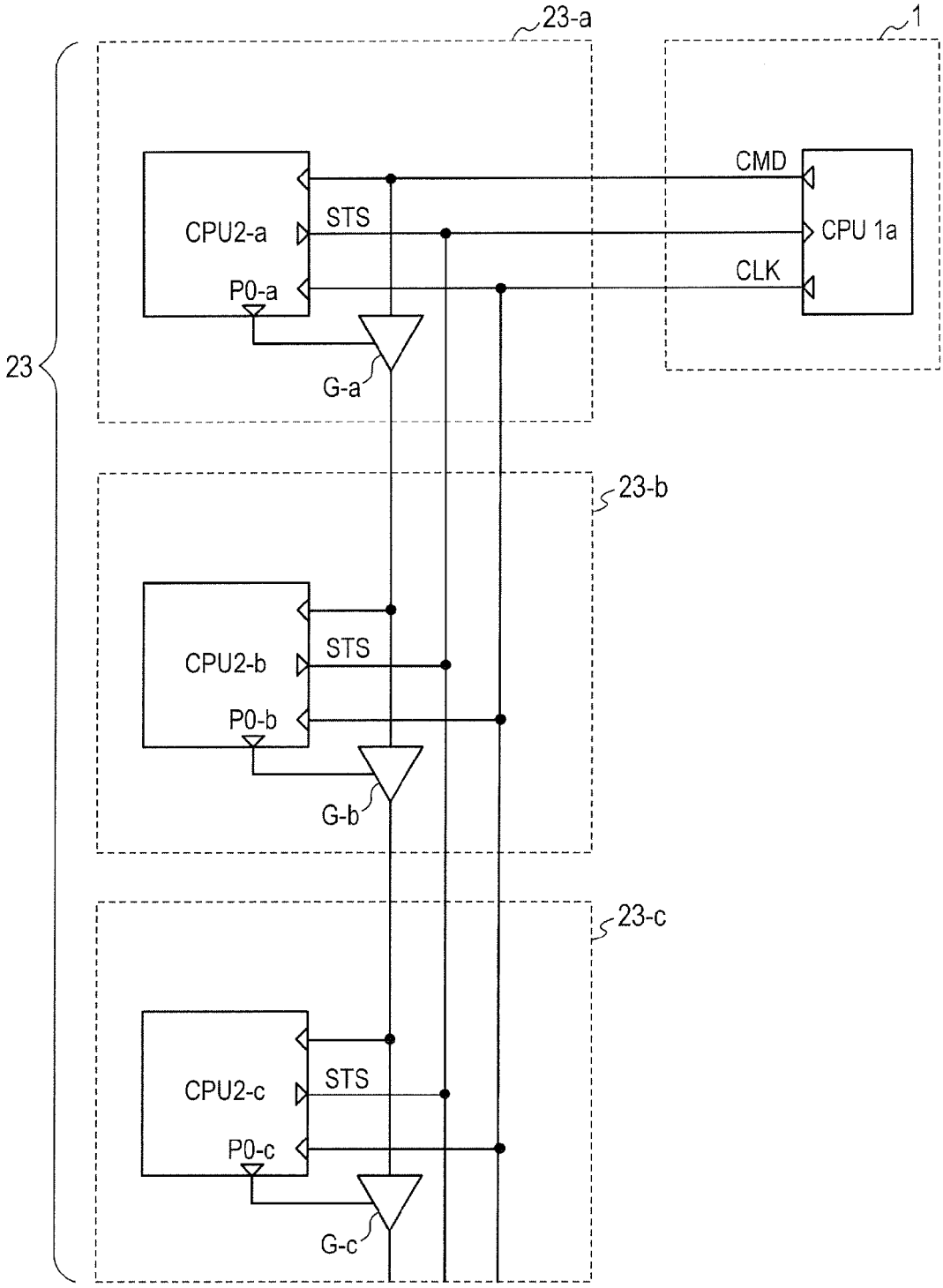
FIG. 6 is a diagram illustrating a configuration of connection between a conventional image forming apparatus and sheet feeding option devices.

A control sequence of setting address data to the extended IO of each of the sheet feeding option devices 23-*a*, 23-*b* and 23-*c* is now described with reference to FIG. 5. FIG. 5 is a flowchart illustrating a control sequence of the CPU 1*a* of the image forming apparatus 1 setting address data in the extended IO of each sheet feeding option device 23. Procedures of setting the address data of each extended IO based on the configuration illustrated in FIG. 4 where the sheet feeding option devices 23-*a*, 23-*b* and 23-*c* are attached are hereinafter described. The control sequence illustrated in FIG. 5 is activated when the power supply to the sheet feeding option device 23 is turned on. When the power supply to the sheet feeding option device 23 is turned on, the power-on-reset function in the extended IO embedded in each of the sheet feeding option devices 23-*a*, 23-*b* and 23-*c* operates. Accordingly, the resister in each extended IO is cleared, the universal ports P0 to P2 are set to the high-impedance state, and the address setting terminals A1 and A0 are brought into a state where the high level signals are input.

In S201, the CPU 1*a* of the image forming apparatus 1 transmits an SDA signal designating the extended IO where address information is 1 and 1, that is, the address setting terminals A1 and A0 are 1 and 1, respectively, to communicate with the extended IO-a of the sheet feeding option device 23-*a*. The extended IO-a of the sheet feeding option device 23-*a* reads the address information transmitted through the SDA signal, and compares the information with the input states of the address setting terminals A1 and A0. Since the input states of the terminals A1 and A0 are 1 and 1, that is, the high level signals are input, the extended IO-a then sets an ACK signal that is a reply signal in the SDA signal, and transmits the signal to the CPU 1*a* of the image forming apparatus 1.

In S202, the CPU 1*a* of the image forming apparatus 1 reads the reply signal to the transmitted address information, and determines whether the signal is the ACK signal or not. If the signal is the ACK signal, the processing proceeds to S204. If the signal is not the ACK signal, the processing proceeds to S203. In S203, the CPU 1*a* of the image forming apparatus 1 determines that there is no connection of and after the sheet feeding option device 23-*a*, that is, the sheet feeding option devices 23-*a*, 23-*b* and 23-*c* are not attached, and finishes the processing.

In S204, the CPU 1*a* of the image forming apparatus 1 then transmits, to the extended IO-a, the SDA signal for setting the address information on the extended IO-b to confirm presence or absence of the sheet feeding option device 23-*b*. That is, the CPU 1*a* of the image forming apparatus 1 transmits the SDA signal where the port information to be set in the universal ports P2, P1 and P0 of the extended IO-a is 0, 0 and 0, that is, the outputs of the universal ports P2, P1 and P0 are for setting low level. The extended IO-a, having received the SDA signal, sets the universal ports P2-*a*, P1-*a* and P0-*a* that are in the high-impedance state to low level, respectively, thereby causing the universal ports P2-*a*, P1-*a* and P0-*a* to output the low level signals. As illustrated in FIG. 4, the outputs of the universal ports P1-*a* and P0-*a* are input into the terminals A1-*a* and A0-*a* of the extended IO-a. The address information on the extended IO-a is set to 0 and 0, respectively.

Subsequently, in S205, the CPU 1*a* of the image forming apparatus 1 outputs the SDA signal where port information to be set in the universal ports P2, P1 and P0 of the extended IO-a is 1, 0 and 0, that is, the output of the universal port P2 is set to high level and the outputs of the ports P1 and P0 are remained in low level. The extended IO-a, having received the SDA signal, changes the output of the universal port P2-*a* from low level to high level, and the high level signal is output from the universal port P2-*a* and input into the gate circuit G-a. The gate circuit G-a receives the high level signal from the universal port P2-*a*, thereby supplying (relaying) the SCL signal that is the serial clock signal to the extended IO-b of the sheet feeding option device 23-*b* on the middle stage.

In S206, the CPU 1*a* of the image forming apparatus 1 transmits the SDA signal designating the extended IO-b where address information is 1 and 1, that is, the address setting terminals A1 and A0 are 1 and 1, respectively to communicate with the extended IO-b of the sheet feeding option device 23-*b*. The extended IO-b of the sheet feeding option device 23-*b* reads the address information transmitted through the SDA signal, and compares the information with the input states of the terminals A1 and A0. As described above, the terminals A1 and A0 of the extended IO-b receive the high level signals at the same level as that of the power supply voltage, via the pull-up resistors. Accordingly, an ACK signal that is a reply signal is set in an SDA signal, and the signal is transmitted to the CPU 1*a* of the image forming apparatus 1.

In S207, the CPU 1*a* of the image forming apparatus 1 reads the reply signal to the transmitted address information, and determines whether the signal is the ACK signal or not. If the signal is the ACK signal, the processing proceeds to S209. If the signal is not the ACK signal, the processing proceeds to S208. In S208, the CPU 1*a* of the image forming apparatus 1 determines that there is no connection of and after the sheet feeding option device 23-*b*, that is, the sheet feeding option devices 23-*b* and 23-*c* are not attached, and finishes the processing.

In S209, the CPU 1*a* of the image forming apparatus 1 transmits, to the extended IO-b, the SDA signal for setting the address information on the extended IO-b. That is, the CPU 1*a* of the image forming apparatus 1 transmits the SDA signal where port information to be set in the universal ports P2, P1 and P0 of the extended IO-b is 0, 1 and 0, that is, the output of the universal port P2 is set to low level, the output of the port P1 high level, and the output of the port P0 low level. The extended IO-b, having received the SDA signal, sets the universal ports P2-*b*, P1-*b* and P0-*b* that are in the high-impedance state to low level, high level and low level, respectively. Accordingly, from the universal ports P2-*b*, P1-*b* and P0-*b*, the low level signal, the high level signal and the low level signal are output, respectively. As illustrated in FIG. 4, the outputs of the universal ports P1-*b* and P0-*b* are input into the terminals A1-*b* and A0-*b* of the extended IO-b, respectively, and the address information on the extended IO-b is set to 1 and 0, respectively.

Subsequently, in S210, the CPU 1*a* of the image forming apparatus 1 transmits the SDA signal where port information to be set in the universal ports P2, P1 and P0 of the extended IO-b is 1, 1 and 0, that is, the outputs of the universal ports P2 and P1 are set to high level and the output of the port P0 low level. The extended IO-b, having received the SDA signal, changes the output of the universal port P2-*b* from low level to high level. The high level signal is output from the universal port P2-*b*, and input into the gate circuit G-b. The gate circuit G-b receives the high level signal from the universal port P2-*b*, thereby supplying (relaying) the SCL signal that is the serial clock signal to the extended IO-c of the sheet feeding option device 23-*c* on the lower stage.

In S211, the CPU 1*a* of the image forming apparatus 1 transmits the SDA signal designating the extended IO-c where address information is 1 and 1, that is, address setting terminals A1 and A0 are 1 and 1, respectively, to communicate with the extended IO-c of the sheet feeding option device 23-*c*. The extended IO-c of the sheet feeding option device 23-*c* reads the address information transmitted through the SDA signal, and compares the information with the input states of the terminals A1 and A0. As described above, the terminals A1 and A0 of the extended IO-c receive the high level signals at the same level as that of the power supply voltage, via the pull-up resistors. Accordingly, an ACK signal that is a reply signal is set in an SDA signal and the signal is transmitted to the CPU 1*a* of the image forming apparatus 1.

In S212, the CPU 1*a* of the image forming apparatus 1 reads the reply signal to the transmitted address information, and determines whether the signal is the ACK signal or not. If the signal is the ACK signal, the processing proceeds to S214. If the signal is not the ACK signal, the processing proceeds to S213. In S213, the CPU 1*a* of the image forming apparatus 1 determines that there is no connection to the sheet feeding option device 23-*c*, that is, the sheet feeding option device 23-*c* is not attached, and finishes the processing.

In S214, the CPU 1*a* of the image forming apparatus 1 transmits an SDA signal where the port information to be set in the universal ports P2, P1 and P0 of the extended IO-c is 0, 0 and 1, that is, the outputs of the universal ports P2 and P1 are set to low level and the output of the port P0 high level. That is, the CPU 1*a* of the image forming apparatus 1 transmits the SDA signal where port information to be set in the universal ports P2, P1 and P0 of the extended IO-c is 0, 0 and 1, that is, the outputs of the universal ports P2 and P1 are set to low level and the output of the port P0 high level. The extended IO-c, having received the SDA signal, sets the universal ports P2-*c*, P1-*c* and P0-*c* that are in the high-impedance state to low level, low level and high level, respectively. Accordingly, the universal ports P2-*c*, P1-*c* and P0-*c* output the low level signal, the low level signal and the high level signal, respectively. As illustrated in FIG. 4, the outputs of the universal ports P1-*c* and P0-*c* are input into the terminals A1-*c* and A0-*c* of the extended IO-c, the address information on the extended IO-c is set to 0 and 1, respectively, and the processing is finished.

FIG. 5 only illustrates the reception confirmation of the ACK signal in the case where the CPU 1*a* of the image forming apparatus 1 transmits the address information to the extended IO of the sheet feeding option device 23. In the case of setting data in the universal port, description of a process of determining the reception confirmation of the ACK signal is omitted. If the ACK signal is not received during data setting into the universal port, the CPU 1*a* of the image forming apparatus 1 may execute a process of setting data in the universal port again. The order of the address data items setting in the extended IO illustrated in FIG. 5 is an example. Except for the data on address setting terminals A1 and A0, (1, 1), indicating that the address data has not been set, the order of address data to be set is not necessarily (0, 0)-(1, 0)-(0, 1), which is illustrated in FIG. 5.

Although FIG. 4 illustrates no drawer connector, various signals to be relayed between the sheet feeding option devices 23 are relayed via drawer connectors between the sheet feeding option devices 23 as described above. In this embodiment, the universal ports P1 and P0 of the extended IO are connected to the respective address setting terminals A1 and A0 of the same extended IO, but are not connected to the address setting terminals A1 and A0 of the extended IO of the sheet feeding option device 23 on the downstream side; this configuration is different from Embodiment 1. Accordingly, the configuration described in this embodiment can remove two signal lines connected to the address setting terminals A1 and A0 from the signal lines passing through the drawer connectors. Thus, in comparison with Embodiment 1, the sizes of the upper-stage-side drawer connector and the lower-stage-side drawer connector of the sheet feeding option device 23 can be reduced, which can in turn reduce the cost.

In the above embodiments, the description has been made assuming the configuration of the image forming apparatus 1 that forms a monochrome image. However, the present invention is also applicable to color image forming apparatuses. Applicable color image forming apparatuses include a color image forming apparatus in which photosensitive drums as image bearing members for forming images having yellow, magenta, cyan and black colors are arranged and which transfers the images from the respective photosensitive drums to a recording medium or an intermediate transfer body. The applicable apparatuses also include a color image forming apparatus which sequentially forms images having the colors on one image bearing member (photosensitive drum), forms a color image on an intermediate transfer body, and transfers the color image onto a recording medium.

Furthermore, in the above embodiments, the image forming apparatus 1 that includes the sheet feeding option devices 23 to be attached to the image forming apparatus 1 has been described. The option devices other than the sheet feeding option devices 23 include, for instance, an option device which is referred to as a "finisher", connected to the image forming apparatus 1, and automatically sorts, arranges, staples and binds recording media printed by the image forming apparatus 1. Also in the image forming system that includes an option device connectable to the image forming apparatus 1 and the image forming apparatus 1, which are connected to each other, the above-described extended 10 may be provided in the option device, and communication is performed with the image forming apparatus, thereby exerting advantageous effects similar to those of the above embodiments. As described above, this embodiment can set the addresses of the option devices with a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-076226, filed Apr. 2, 2014, which is hereby incorporated by reference herein in its entirety.

What is claimed is:

1. An image forming system, comprising:

an image forming apparatus; and an option device connectable to the image forming apparatus, wherein the image forming apparatus includes a communication unit that performs data communication with the option device via a communication line, wherein the option device includes a receiving unit that receives data transmitted from the image forming apparatus via the communication line, a transmitting unit that transmits data to the image forming apparatus via the communication line, and a setting unit that includes a setting port where a value is set in a state of being connected to the image forming apparatus, and an input/output port, and wherein the setting unit executes comparison between a value of first data received from the image forming apparatus and the value set in the setting port, and transmits a response signal to the image forming apparatus according to a result of the comparison, and the image forming apparatus transmits recognition data on the option device to the option device according to the response signal, and the setting unit sets a value of a signal at the input/output port based on the recognition data.

2. An image forming system according to claim 1, wherein the input/output port and the setting port of the setting unit are connected to a power supply.

3. An image forming system according to claim 1, wherein the input/output port of the setting unit is connected to the setting port of another different option device.

4. An image forming system according to claim 1, wherein the option device is connected in cascade.

5. An image forming system according to claim 1, wherein the recognition data is different for each option device.

6. An image forming system according to claim 1, wherein the communication line includes a clock signal line that supplies a clock signal, and a data signal line that supplies a data signal, and the image forming apparatus and the setting unit perform serial communication with each other using the data signal line in synchronization with the clock signal.

7. An image forming system according to claim 6, wherein the option device is further connected to the clock signal line, and includes a gate unit that outputs or blocks the clock signal according to an output of the input/output port of the setting unit.

8. An image forming system according to claim 7, wherein after the image forming apparatus sets the recognition data in the setting unit, and the apparatus transmits data for outputting the clock signal from the gate unit to the setting unit.

9. An image forming system according to claim 1, wherein when a power supply to the option device is turned on, the image forming apparatus sets the recognition data in the setting unit of the option device.

10. An image forming system according to claim 1, wherein when a power supply to the option device is turned on, a predetermined value is input into the setting port of the setting unit, and the input/output port is set to a high impedance state.

11. An image forming system according to claim 1, wherein the option device is a sheet feeding device for supplying the image forming apparatus with a recording medium.

12. An option device connectable to an image forming apparatus, comprising:

a receiving unit that receives data transmitted from the image forming apparatus;

a transmitting unit that transmits data to the image forming apparatus; and a setting unit that includes a setting port where a value of a signal is set in a state of being connected to the image forming apparatus, and an input/output port where a value of a signal is set based on data transmitted from the image forming apparatus;

wherein the setting unit executes comparison between a value of first data transmitted from the image forming apparatus and the value set in the setting port, transmits a response signal to the image forming apparatus according to a result of the comparison, and sets the value of the signal at the input/output port based on recognition data on the option device transmitted from the image forming apparatus.

13. An option device according to claim 12, wherein the input/output port and the setting port of the setting unit are connected to a power supply.

14. An option device according to claim 12, wherein the input/output port of the setting unit is connected to the setting port of another different option device.

15. An option device according to claim 12, wherein the option device is a sheet feeding device for supplying the image forming apparatus with a recording medium.

* * * * *